US006650866B1

(12) United States Patent
Ahl et al.

(10) Patent No.: US 6,650,866 B1
(45) Date of Patent: Nov. 18, 2003

(54) TRANSFER APPARATUS

(75) Inventors: David K. Ahl, Rochester, NY (US); Douglas A. McKeown, Geneseo, NY (US); Robert A. Gross, Penfield, NY (US); Michael G. Petranto, Webster, NY (US); Youti Kuo, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/251,589

(22) Filed: Sep. 20, 2002

(51) Int. Cl.[7] ..... G03G 15/00
(52) U.S. Cl. ..... 399/388; 399/316
(58) Field of Search ..... 399/316, 317, 399/388, 381, 397, 400

(56) References Cited

U.S. PATENT DOCUMENTS 4,087,169 A 5/1978 Fantuzzo ..... 399/313
4,544,262 A * 10/1985 Kanemitsu ..... 399/316
5,311,267 A 5/1994 Bean ..... 399/164
5,678,122 A * 10/1997 Gross ..... 399/388 X
5,729,788 A 3/1998 Hirohashi et al. ..... 399/66
5,920,746 A 7/1999 Thomas et al. ..... 399/45
6,055,409 A * 4/2000 Richards et al. ..... 399/388
6,198,903 B1 * 3/2001 Benedict ..... 399/388
6,512,904 B2 * 1/2003 Sato et al. ..... 399/316 X
2001/0033760 A1 * 10/2001 Sawanaka et al. ..... 399/316

* cited by examiner

*Primary Examiner*—Sandra Brase
(74) *Attorney, Agent, or Firm*—Lloyd F. Bean, II

(57) ABSTRACT

An apparatus which transfers a developed image from a photoconductive member to a sheet. A sheet baffle guides an advancing sheet to the photoconductive member at the transfer station. A sheet guide having an elongated axis extending in a transverse direction to the planar surface of the imaging member; said sheet guide including a roller assembly on a sheet exit portion of said sheet guide.

8 Claims, 2 Drawing Sheets

TRANSFER APPARATUS

TRANSFER APPARATUS

Figure 1:
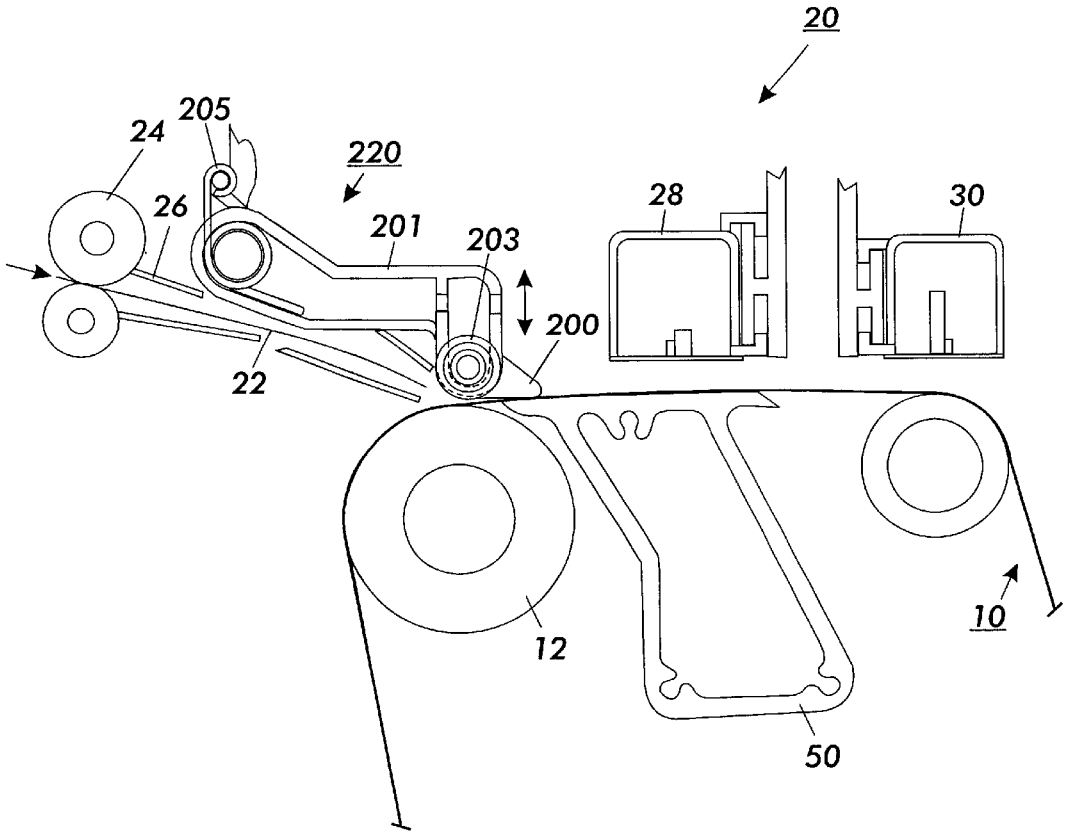

This invention relates generally to an electrophotographic printing machine, and more particularly, concerns an apparatus for transferring a developed image from a photoconductive surface to a sheet.

A typical electrophotographic printing machine employs a photoconductive member that is charged to a substantially uniform potential so as to sensitize the surface thereof. The charged portion of the photoconductive surface is exposed to a light image. Exposure of the charged photoconductive surface selectively dissipates the charge thereon in the irradiated areas to record an electrostatic latent image on the photoconductive surface corresponding to the informational areas being reproduced by the printing machine. After the electrostatic latent image is recorded on the photoconductive surface, the latent image is developed by bringing a developer material into contact therewith. Generally, the electrostatic latent image is developed with dry developer material having carrier granules with toner particles adhering thereto. However, a liquid developer material may be used as well. The toner particles are attracted to the latent image forming a visible image on the photoconductive surface. After the electrostatic latent image is developed with the toner, the toner image is transferred to a sheet. The toner image is then heated to permanently fuse it to the sheet.

High speed commercial printing machines of the foregoing type handle a wide range of differing weight sheets. The beam strength of the sheet is a function of the weight of the sheet. Heavy weight sheets have greater beam strength than lighter weight sheets. It is not unusual for the sheet to be cockled before it is transported to the processing station where the developed image is transferred to the sheet. The second side of duplex sheets may also suffer from cockle due to the image on the first side and the effect of the fuser on the sheet. This is the single greatest cause for cockle. The stack of sheets placed in the sheet feeder may be initially cockled, or the sheets may become cockled as they are fed from the stack to the transfer station. At the transfer station, the sheet adheres to the photoconductive member. In the event the sheet is cockled, it is not held in intimate contact with the photoconductive surface, but rather spaces occur between the developed image on the photoconductive surface and the sheet. In the electrostatic transfer of the toner image to the sheet, it is necessary for the sheet to be in uniform, intimate contact with the toner powder image developed on the photoconductive surface. Failure to do so results in variable transfer efficiency and, in the extreme, areas of low or no transfer resulting in image deletions. Pretransfer sheet guides can be used to put an "S" bend in the sheet. This "S" bend will force the paper flat against the photoconductive surface as it enters the transfer region. The higher the degree of the "S" bend, the more normal a flattening force can be achieved. However, optimal sheet entry angles for lightweight sheets are not necessarily optimal for heavyweight sheets. Various types of baffle arrangements have been employed heretofore.

U.S. Pat. No. 5,311,267 (Bean), the disclosure of which is totally incorporated herein by reference, discloses a combination of a roller and baffle used to impart a curvilinear or S-shape to the sheet. The baffle may be moved to vary the shape of the sheet as the sheet moves into the transfer zone.

U.S. Pat. No. 5,678,122 (Gross), the disclosure of which is totally incorporated herein by reference, discloses a moveable baffle and a sheet basis weight sensing unit which detects the weight of the sheet. The signal from the sensing unit is sent to a controller which, in conjunction with an electromechanical device coupled thereto, moves the guide to provide the proper bend for the sheet.

There is provided an apparatus for transferring a developed image from an imaging member having a generally planar surface to a sheet, including: a sheet guide having an elongated axis extending in a transverse direction to the planar surface of the imaging member; said sheet guide including a roller assembly on a sheet exit portion of said sheet guide.

There is also provided an electrophotographic printing machine of the type in which a developed image from an imaging member having a generally planar surface to a sheet, including: a sheet guide having an elongated axis extending in a transverse direction to the planar surface of the imaging member; said sheet guide including a roller assembly on a sheet exit portion of said sheet guide.

Figure 2:
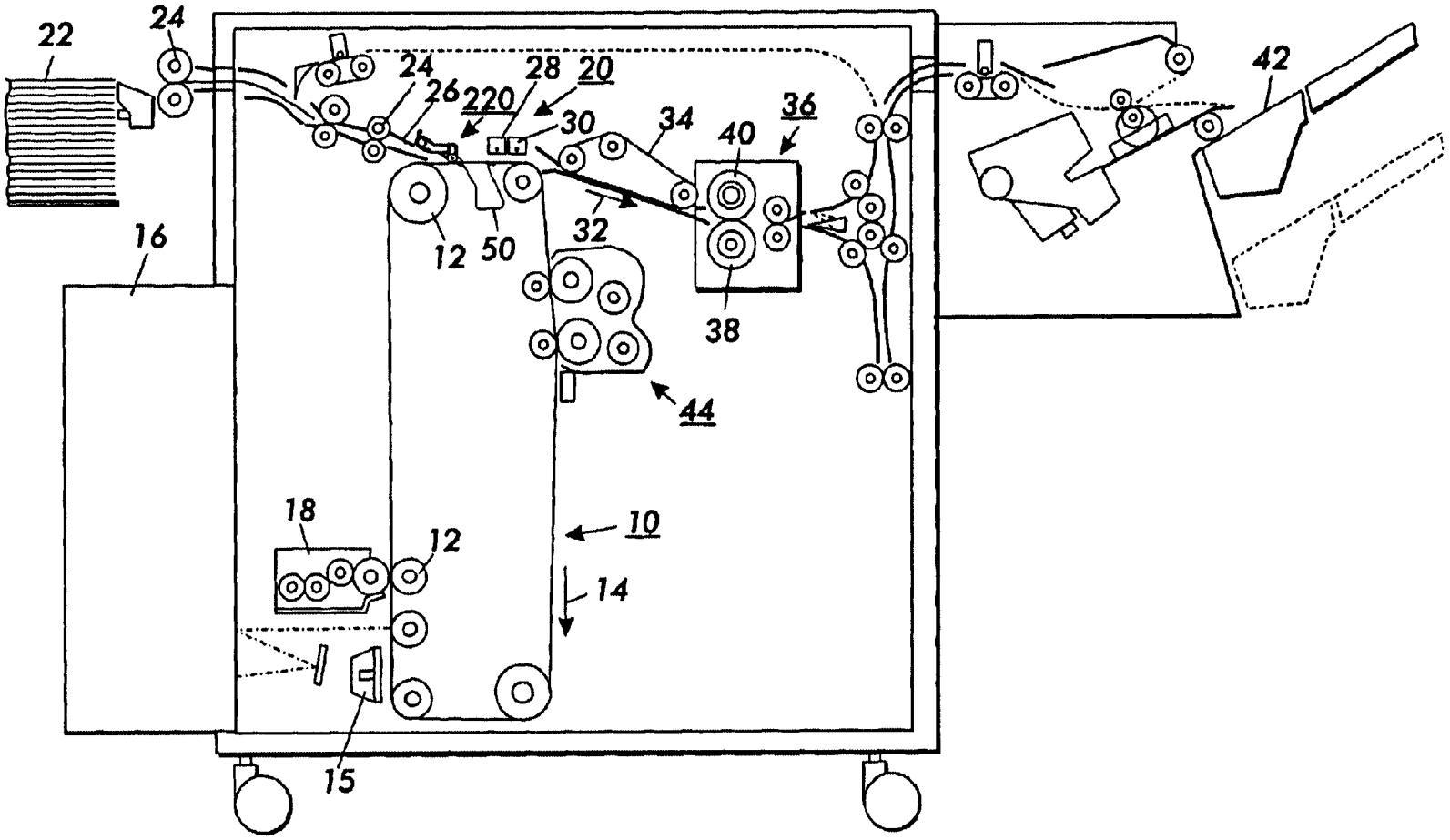

Other aspects of the present invention will become apparent as the following description proceeds and upon reference to the drawings, in which:

FIG. 1 is an elevational view showing the transfer station with the sheet baffle positioned to handle a heavyweight sheet; and FIG. 2 is a schematic elevational view depicting an illustrative electrophotographic printing machine incorporating the apparatus of the present invention therein.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Referring initially to FIG. 2, there is shown an electrophotographic printing machine having the transfer apparatus of the present invention therein. The printing machine employs a photoconductive belt 10 supported by a plurality of rollers or bars 12. Photoconductive belt 10 is arranged in a vertical orientation and advances in the direction of arrow 14. Successive portions of the photoconductive surface of belt 10 advance sequentially to the various processing stations disposed about the path of movement thereof.

Initially, belt 10 passes through charging station 15. At the charging station, a corona generating device charges the photoconductive surface of belt 10 to a relatively high, substantially uniform potential. After the photoconductive surface of belt 10 is charged, the charged portion thereof is advanced to the exposure station.

At the exposure station, an imaging beam generated by a raster output scanner (ROS) 16 creates an electrostatic lightened image on the photoconductive surface of belt 10. One skilled in the art will appreciate that a laser diode ray may be used as well. This electrostatic latent image is developed by developer unit 18.

Developer unit 18 deposits toner particles on the electrostatic latent image. In this way, a toner powder image is formed on the photoconductive surface of belt 10. After the toner powder image has been developed on the photoconductive surface of belt 10, belt 10 continues to advance in the direction of arrow 14 to transfer station 20.

At transfer station 20, a sheet of support material, e.g. paper, is advanced from stack 22 by a sheet feeding apparatus. The topmost sheet is advanced by forwarding rollers 24 to transfer station 20. At transfer station 24, guide baffle 26 is positioned to guide the leading edge of the sheet so as to be tacked to belt 10 in registration with the developed toner powder image thereon. The sheet, in contact with the toner powder image on belt 10, is advanced with belt 10 in the direction of arrow 14 to corona generator 28. Corona generator 28 sprays ions onto the backside of the sheet to effectuate the transfer of the toner powder image from belt 10 to the sheet. The sheet is maintained against belt 10 during the transfer process and eventually the lead edge of the sheet reaches, or is advanced beneath corona generator 30. As the belt proceeds around roller 12, the sheet, now having the toner powder image deposited thereon, proceeds in the direction of arrow 32 on vacuum transport 34. Vacuum transport 34 moves the sheet in the direction of arrow 32 to fusing station 36.

Fusing station 36 includes a fuser roller 38 and a backup roll 40. The backup roll 40 is resiliently urged into engagement with fuser roll 38 to form a nip through which the sheet passes. In the fusing operation, the toner particles coalesce with one another and bond to the sheet in image configuration forming an image thereon. After fusing, the finished sheet is discharged to catch tray 42.

Invariably, after the toner powder image has been transferred to the sheet, residual toner particles remain adhering to the photoconductive surface of belt 10. These residual toner particles are removed therefrom at cleaning station 44. After cleaning the photoconductive surface of belt 10, the cycle is repeated for the next successive print.

Referring now to FIG. 1, there is shown the details of transfer station 20. Guide baffles 26 are designed to put an S-bend in the sheet. The S-bend will force the sheet flat against belt 10 as it enters the transfer region. The problem arises in that with higher normal forces, the amount of drag through the baffles increases. This becomes a problem after the trail edge of the sheet leaves the registration nip and is no longer being driven. If the drag becomes too high, the tacking of the sheet to belt 10 may not be sufficient to permit belt 10 to pull the sheet from the baffles, this will result in a smear or disturbance of the image being transferred to the sheet. Testing has shown that the primary contributor to the increase in normal force is the angle of guide baffles 26 or the angle of the tack of the sheet to belt 10.

The present invention includes baffle 22, which guides the lead edge of the sheet to the roller 203. The roller is held by two arms 201 that contain ball bearings and allows the roller 203 to deflect for heavy sheets. The roller returns to the run (biased) position before the sheet enters the transfer corona. These arms are biased against the photoreceptor backer bar 50 by torsion springs 205. Foot portion 200 tightly controls the gap between roller and the photoreceptor. The use of a movable surface of the roller decreases the impact to the motion quality of the photoreceptor when the sheet first enters the transfer subsystem. The impact is also decreased toward the end of the sheet, when the sheet leaves the registration assembly drive nip, and finally when the trail edge of the sheet leaves the baffle.

An additional advantage to the spring loading concept is that the spacing between the roller and the belt may be accurately controlled. The roller arms are biased directly on the photoreceptor backer, thus decreasing the effect of the tolerances between the belt location and the transfer subsystem.

The present invention replaces this fixed baffle with a spring-loaded ball bearing roller assembly 220. In this way, the tacking force or pulling force between belt 10 and the sheet is sufficient to enable the sheet to be dragged through the guide baffles without introducing any smear of the image. By using a roller instead of a stationary baffle, the drag on the sheet is substantially reduced. This reduces the motion quality impact to the photoreceptor. By spring loading the roller, it is allowed to deflect when the heavy sheets first contact the photoreceptor, thereby reducing the peak force to deflect the sheet. The spring is designed, however, to be strong enough to return to its normal position when the sheet becomes tangent to the photoreceptor, so the correct tangency point is achieved. The tangency point is the earliest point at which the sheet and the belt 10 come into intimate contact. The location of this point with respect to the corona generator is important, since if the sheet contacts too early, any slippage between the sheet and the belt will cause the image to smear. Conversely, if the tangency point is too late, the electrical breakdown limit of the air gap between the sheet and the belt may be exceeded (Paschen breakdown), causing poor image transfer. An additional benefit is that the spacing of the roller to the photoreceptor belt (which is critical to achieving a reliable tangency location) is tightly controlled, since the roller is spring loaded directly to the photoreceptor backer bar, thus decreasing the tolerance stack up.

When a heavy weight paper sheet enters the transfer subsystem and first contacts the photoreceptor, a high force is exerted against the belt, and against the "lower control point". This control point is replaced with a small roller, which runs the length of the sheet. The roller is spaced close to the photoreceptor belt (preferably at a 1.5 millimeter gap) to provide a normal force between the paper and the photoreceptor during the transfer cycle. This, however, results in a high peak force when the sheet initially contacts the photoreceptor belt. By allowing the roller surface to move with the sheet, and allowing it to deflect during the brief period of time when this peak force would otherwise occur, the peak force on the photoreceptor belt is dramatically reduced. Tests on hardware showed that the force to start a sheet into the transfer area was decreased by approximately 75% by the use of this present invention.

In recapitulation, it is clear that the present invention is directed to a transfer apparatus wherein the sheet guide having an elongated axis extending in a transverse direction to the planar surface of the imaging member; said sheet guide including a roller assembly on a sheet exit portion of said sheet guide. This insures that the drag force is maintained at a level such that the sheet moves in unison with the photoconductive belt to prevent smears or distortions of the image. In addition, this insures that the normal force is optimized to flatten the sheet against the photoconductive surface having the toner powder image thereon during the transfer process so as to minimize image deletions.

In recapitulation, there is provided a roller that exerts a force between the sheet and a photoreceptor belt. This force serves to flatten the sheet against the belt, thus providing the intimate contact between the sheet and the photoreceptor required for efficient transfer of a toner powder image to the sheet.

There is also provided a pair of arms containing rolling bearings (preferably ball bearings) which allow the roller to rotate with a minimum of drag force against the sheet. This minimizes the forces tending to create relative motion between the sheet and the photoreceptor belt, thus minimizing the possibility of smearing of the image during the transfer process. Additionally, minimizing the drag force minimizes the impact to the photoreceptor belt when the sheet is released from the final feed nip prior to the photoreceptor. This is important since rapid changes in this drag force will momentarily change the speed of the belt, creating distortion in subsequent images which may be at the exposure station at the time a sheet strikes the photoreceptor.

There is also provided staging "feet" are provided as an integral part of said arms, which contact a backer bar, which in turn supports the photoreceptor belt. Also provided is a pair of springs that bias said feet into contact with the backer bar a small distance outside of the width of the belt, thus maintaining a tight tolerance on the position of the roller with respect to the belt. This tight tolerance is critical to proper transfer of the image.

It is also desirable to allow the transfer assembly to be lifted away from the belt to allow access to any sheets that may become jammed in this area. The motion of these arms under control of said springs allows for this lifting action, while recreating this accurately controlled roller-to-belt gap without the need for tight and costly tolerances on the parts within the transfer assembly that mount the roller assembly.

By proper design of these springs, said roller is allowed to move away from the photoreceptor belt under the force exerted by a thick sheet, thus minimizing the impact to the belt. Again, this is important since high impact forces will change the speed of the belt, creating distortion in subsequent images which may be at the exposure station at the time a sheet strikes the photoreceptor. Said springs are designed to nonetheless exert sufficient force on the sheet to return the roller to its nominal position before the sheet reaches the electrical field of the transfer device, thus positioning the sheet correctly throughout its length.

It is, therefore, apparent that there has been provided in accordance with the present invention, a transfer apparatus which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed:

1. An apparatus for transferring a developed image from an imaging member having a generally planar surface to a sheet, including:

a sheet guide having an elongated axis extending in a transverse direction to the planar surface of the imaging member; said sheet guide including a roller assembly on a sheet exit portion of said sheet guide, said roller assembly includes a roller and a support member for holding said roller, said support member includes a supporting feet member adjacent to said member which provides a predefined distance between said roller and said imaging member.

2. An apparatus according to claim 1, wherein said sheet guide includes:

a generally planar member; and a curvilinear member, spaced from said planar member, to define a sheet path therebetween, for bending the sheet moving through the sheet path.

3. An apparatus according to claim 1, wherein said support member includes a resilient member for permitting said roller to deflect from said predefined distance when a sheet contacts said roller.

4. An apparatus according to claim 1, further including a charging element, positioned adjacent said sheet guide, to charge the sheet exiting the sheet path for establishing a transfer field that is effective to attract the developed image from the photoconductive member to the sheet.

5. An electrophotographic printing machine of the type in which a developed image from an imaging member having a generally planar surface to a sheet, including:

a sheet guide having an elongated axis extending in a transverse direction to the planar surface of the imaging member; said sheet guide including a roller assembly on a sheet exit portion of said sheet guide said roller assembly includes a roller and a support member for holding said roller, said support member includes a supporting feet member adjacent to said member which provides a predefined distance between said roller and said imaging member.

6. An electrophotographic printing machine according to claim 5, wherein said sheet guide includes:

a generally planar member; and a curvilinear member, spaced from said planar member, to define a sheet path therebetween, for bending the sheet moving through the sheet path.

7. An electrophotographic printing machine according to claim 6, further including a charging element, positioned adjacent said sheet guide, to charge the sheet exiting the sheet path for establishing a transfer field that is effective to attract the developed image from the photoconductive member to the sheet.

8. An electrophotographic printing machine according to claim 5, wherein said support member includes a resilient member for permitting said roller to deflect from said predefine distance when a sheet contacts said roller.

* * * * *